US010842303B1

(12) United States Patent
Vieveen

(10) Patent No.: US 10,842,303 B1
(45) Date of Patent: Nov. 24, 2020

(54) ANTI-FATIGUE MAT

(71) Applicant: Checkers Industrial Products, LLC, Broomfield, CO (US)

(72) Inventor: Rene Vieveen, Barendrecht (NL)

(73) Assignee: CHECKERS INDUSTRIAL PRODUCTS, LLC, Broomfield, CO (US)

( * ) Notice: Subject to any disclaimer, the term of this patent is extended or adjusted under 35 U.S.C. 154(b) by 0 days.

(21) Appl. No.: 16/506,832

(22) Filed: Jul. 9, 2019

(51) Int. Cl.
*A47G 27/02* (2006.01)
*E04F 15/02* (2006.01)

(52) U.S. Cl.
CPC ..... *A47G 27/0218* (2013.01); *A47G 27/0293* (2013.01); *E04F 15/02033* (2013.01); *E04F 2201/095* (2013.01)

(58) Field of Classification Search
CPC ..... A47G 27/0218; A47G 27/0293; E04F 2201/02; E04F 2201/026; E04F 2201/0146; E04F 2201/095; E04F 15/02033
USPC ..... 52/302.1, 403.1, 480, 177, 578, 589.1, 52/747.1, 747.11
See application file for complete search history.

(56) References Cited

U.S. PATENT DOCUMENTS 3,751,327 A * 8/1973 Hausler ..... A47G 27/0293 428/33
3,909,996 A * 10/1975 Ettlinger, Jr. ..... E01C 5/20 52/177
4,436,779 A * 3/1984 Menconi ..... E01C 13/045 404/41
4,468,910 A * 9/1984 Morrison ..... A01K 1/0157 52/591.2
4,478,901 A * 10/1984 Dickens ..... A47G 27/0212 404/36
4,807,412 A * 2/1989 Frederiksen ..... A47G 27/0212 52/177
5,456,966 A * 10/1995 Austin ..... A47G 27/0225 404/35
5,490,821 A * 2/1996 Wu ..... A61H 7/001 15/215
7,516,587 B2 * 4/2009 Barlow ..... A63B 69/3661 428/192
7,930,865 B2 * 4/2011 Barlow ..... E04F 15/105 52/741.11
8,266,857 B2 * 9/2012 David ..... E04F 15/087 52/385
9,051,739 B2 * 6/2015 Rosan ..... E04F 15/105
9,180,640 B2 * 11/2015 Masanek, Jr. ..... B29D 99/0057
9,328,521 B2 * 5/2016 Huss ..... E04F 15/02038
9,506,255 B1 * 11/2016 Jones ..... E04F 15/107
(Continued)

FOREIGN PATENT DOCUMENTS

EP 117707 A2 * 9/1984

*Primary Examiner* — Brent W Herring
(74) *Attorney, Agent, or Firm* — Dorsey & Whitney LLP

(57) ABSTRACT

An anti-fatigue modular floor mat includes a set of interlocking tiles. Each tile comprises tabs that extend from an edge of the tile; the tabs can comprise a cavity and a pad opposite the cavity. The tiles can comprise indentations disposed on a bottom of the tile and laterally spaced from the tabs along the edge. Protrusions can extend from the indentation. The tabs can be configured to mate with corresponding indentations on corresponding tiles and the protrusions can be configured to be inserted into corresponding cavities to establish a multi-connection modular floor mat.

20 Claims, 11 Drawing Sheets

(56) References Cited

U.S. PATENT DOCUMENTS

| | | | | |
|---|---|---|---|---|
| 9,534,399 | B2 * | 1/2017 | Huss | E04F 15/02038 |
| D832,468 | S * | 10/2018 | Jones | D25/163 |
| 2007/0223993 | A1 * | 9/2007 | Peterson, Jr. | E01C 5/005 403/364 |
| 2008/0072514 | A1 * | 3/2008 | Barlow | E04F 15/02194 52/540 |
| 2009/0178367 | A1 * | 7/2009 | Barlow | B44C 5/0461 52/745.13 |
| 2009/0266022 | A1 * | 10/2009 | Lin | E04F 15/10 52/506.1 |
| 2011/0120037 | A1 * | 5/2011 | Barlow | B44C 1/28 52/309.1 |
| 2011/0252730 | A1 * | 10/2011 | Rosan | E04F 15/02183 52/302.1 |
| 2013/0291474 | A1 * | 11/2013 | Tillery | E04F 15/02 52/588.1 |
| 2015/0376904 | A1 * | 12/2015 | Huss | E04F 15/02038 52/403.1 |
| 2016/0123021 | A1 * | 5/2016 | Cormier | B29C 45/14 52/403.1 |
| 2016/0138275 | A1 * | 5/2016 | Cormier | E04F 15/225 52/403.1 |
| 2016/0244977 | A1 * | 8/2016 | Huss | E04F 15/225 |
| 2017/0326833 | A1 * | 11/2017 | Neill | B29C 66/1122 |
| 2017/0367513 | A1 * | 12/2017 | Loegering | E04F 15/02188 |
| 2019/0284818 | A1 * | 9/2019 | Penland, Jr. | E01C 5/20 |
| 2020/0008600 | A1 * | 1/2020 | Bing | B32B 3/06 |

* cited by examiner

ANTI-FATIGUE MAT

TECHNICAL FIELD

The present disclosure generally relates to anti-fatigue floor mats for providing durability, comfort and safety for standing workers.

BACKGROUND

In many industries and professions, workers are often required to stand for extended periods of time. Long periods of standing on hard surfaces can be difficult. Floor mats have long been used in an attempt to alleviate fatigue in standing workers. Conventional floor mats come in a variety of shapes, sizes, and configurations. Some floor mats are designed as a single unitary piece. A unitary piece can simplify the installation process, however, unitary mats are often heavy, non-customizable, and difficult to install on a large scale. Modular mats can be made of multiple tiles that connect to form a larger unit. Modular configurations can be assembled and positioned in locations where a unitary mat could not, such as large areas, around corners and long aisle solutions.

Connection methods used by conventional modular mats are often complicated and require numerous pieces. Further, universal connections, such as dovetails, do not create a seamless connection and become separated or uneven over time. To avoid separation, modular mats are often glued together which can be time consuming and costly. Additionally, many traditional connection methods of modular mats require the tiles to be positioned a particular orientation in relation to one another to couple. For instance, traditional tiles might comprise male-only edges and female-only edges. Thus, when attaching two tiles, the installer is required to orient the tiles such that a male-only edge is abutting a female-only edge. Such a configuration is also prone to separation because the tiles can be separated simply by applying a unidirectional force to one of the tiles.

Accordingly, there is a need for improvements to floor mats and specifically to modular floor mats used by standing workers.

SUMMARY

One aspect of the present disclosure relates to a floor mat. The floor mat can comprise a set of interlocking tiles. Each tile can comprise a tab protruding from an edge of the tile; the tab can comprise a cavity opposite the cavity. The tile can comprise an indentation disposed on a bottom of the tile and laterally spaced from the tab along the edge. A protrusion can extend from the indentation. The tab can be configured to mate with a corresponding indentation on a corresponding tile and the protrusion can be configured to be inserted into a corresponding cavity on a corresponding tab on the corresponding tile.

The tile can comprise multiple edges, with each edge being identical to one another, such that any one of the multiple edges can mate with the corresponding tile. The bottom of the tile can comprise a plurality of pads configured to allow the tile to bend and flex. The pad on the tab can be a cushioned dome. The cavity of the tab can define an interior of the pad of the tab. The top of the tile can comprise a gripping surface. In some embodiments, the tile can comprise an open drainage system. The open drainage system can be incorporated into the top of the tile or along the edges to avoid standing water or other liquids on the tile.

The tile can be made of material that is capable of deforming under the weight of a person.

Upon interlocking the tile, the corresponding tile can be approximately flush, such that interlocking the tile with a corresponding tile does not increase the thickness of the floor mat. One edge of the tile can be beveled to create a ramp onto the floor mat.

The floor mat can further comprise a ramp comprising an interlocking edge configured to abut and interlock with a second edge of the tile. The ramp can comprise a ramp tab protruding from the interlocking edge of the ramp. The ramp tab can comprise a ramp cavity and a ramp pad opposite the ramp cavity. A ramp indentation can be disposed on a bottom of the ramp and laterally spaced from the ramp tab along the interlocking edge and a ramp protrusion can extending from the ramp indentation. The ramp tab can be configured to mate with a second indentation disposed on the bottom of the tile, proximate the second edge of tile, and the ramp cavity can be configured to receive a second protrusion extending from the second indentation.

The ramp can be configured to mate with any edge of the tile to create a beveled edge of the floor mat. The ramp can comprise a mitered corner. The ramp can comprise a flange that protrudes from the ramp and couples with an adjoining ramp to form a beveled corner.

In another aspect, the present disclosure relates to a method for interlocking two tiles to form a floor mat. The method can comprise providing a first tile, the first tile can comprise a tab protruding from an edge of the tile. The tab can comprise a cavity and a pad opposite the cavity. An indentation can be disposed on a bottom of the tile and laterally spaced from the tab along the edge, and a protrusion extending from the indentation. The method can further comprise providing a second tile, the second tile can comprise a second tab protruding from an abutting edge of the second tile, the second tab can comprise a second cavity and a second pad opposite the second cavity. A second indentation can be disposed on a bottom of the second tile and laterally spaced along the abutting edge from the second tab, and a second protrusion can extend from the second indentation. The method can further comprise mating the tab with the second indentation and inserting the protrusion into the second cavity.

The tile can comprise multiple edges, any one of which can mate with the abutting edge of the second tile. Interlocking the tile with the second tile does not increase the thickness of the floor mat. Upon interlocking, the tile and the corresponding tile are approximately flush.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of illustrative embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
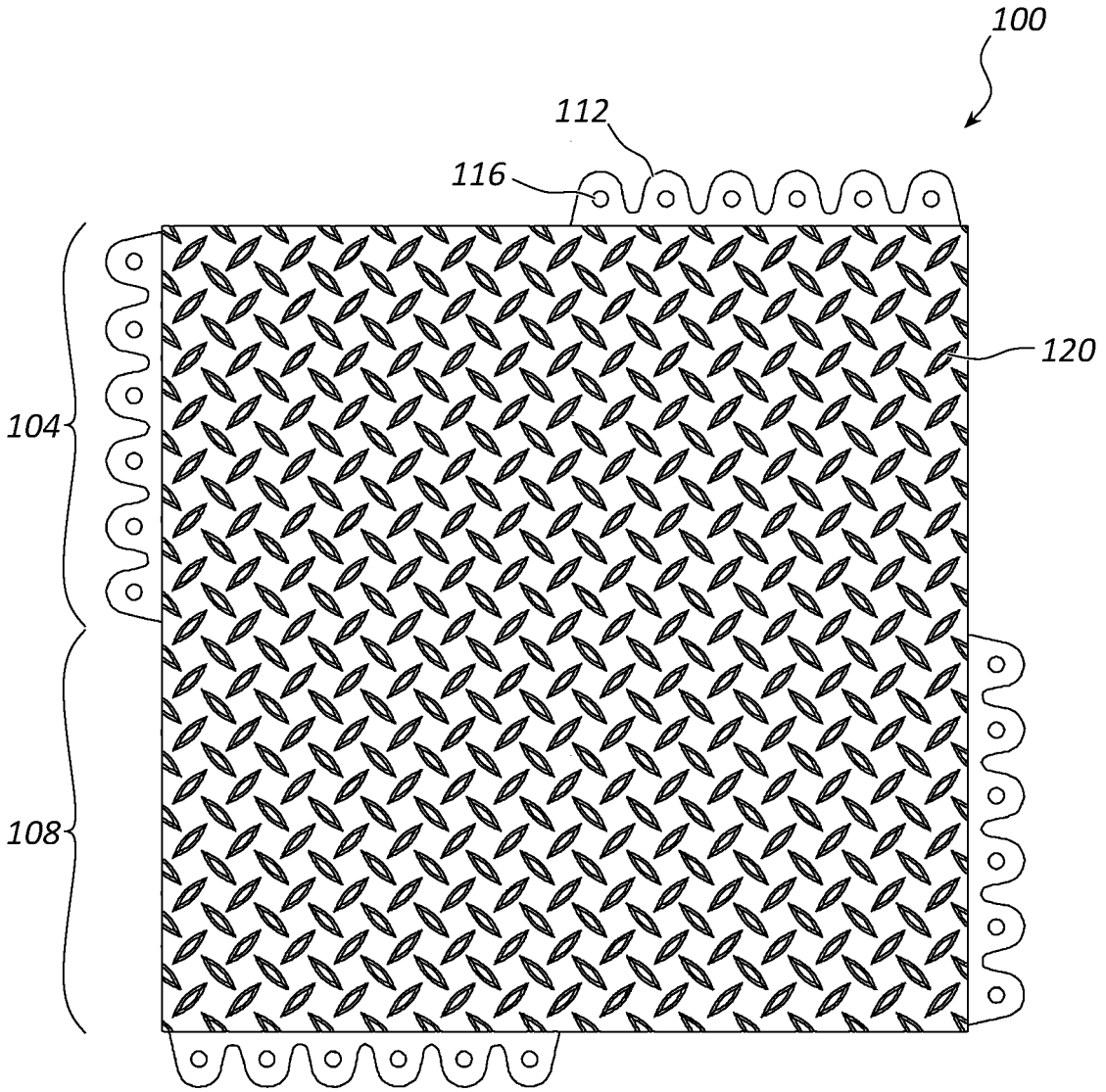
FIG. 1 is a top view of a tile in accordance with one embodiment.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure generally relates to an anti-fatigue floor mat for use by standing workers in manufacturing plants, production lines, assembly lines, CNC machines, individual workstations, custom work platforms, etc. The floor mat can be assembled from modular tiles configured to connect with one another. Each tile edge can include a multi-connection interlocking system that utilizes tabs and indentations configured to mate with corresponding tabs and indentations on other tiles.

FIG. 1 is a top view of a tile 100 that can be combined with other tiles to assemble a floor mat in accordance with one embodiment. The tile 100 can be made from flexible and durable rubber compounds that provides a natural rebound resilience and creates deflection that stimulates automatic balance checks to improve posture and constant micro movements to maintain blood flow. The materials used can include NR, NBR, NR ESD, NBR FR ESD and NBR FR.

In some embodiments, the tile 100 can be made from specialized rubber compounds for general purpose applications, resistance to industrial oils, ESD static dissipative and fire retardant applications. The tile 100 can be manufactured using a compression molding process.

The tile 100 is shown as a square, however, other multi-sided shapes are possible (e.g., triangle, rectangle, pentagon, hexagon, etc.). In some embodiments, the tile 100 can be approximately 45 cm×45 cm and can weigh approximately 3.3 kg.

The tile 100 can include substantially straight edges. Each edge can include a tabbed portion 104 and an indented portion 108. The indented portion 108 can be a recessed portion or female portion. The tabbed portion 104 can be an extension portion or a male portion. In some aspects, there can be multiple tabbed portions 104 and multiple indented portions 108 along each edge of the tile 100. In some aspects there can be alternating segments of tabbed portions 104 and indented portions 108. The tabbed portion 104 can include one or more flanges, extensions, or tabs 112 that extend from the edge of the tile 100. The tabs 112 can extend in a planar direction of the tile 100. Each tab 112 can comprise a recess, aperture, or cavity 116 in the top of the tab 112. The tile 100 can further include traction elements 120 on its top surface, such as diamond plate traction. A diamond plate surface can provide traction while still allowing easy twist and turn maneuvers for freedom of movement in dynamic workstations.

Figure 2:
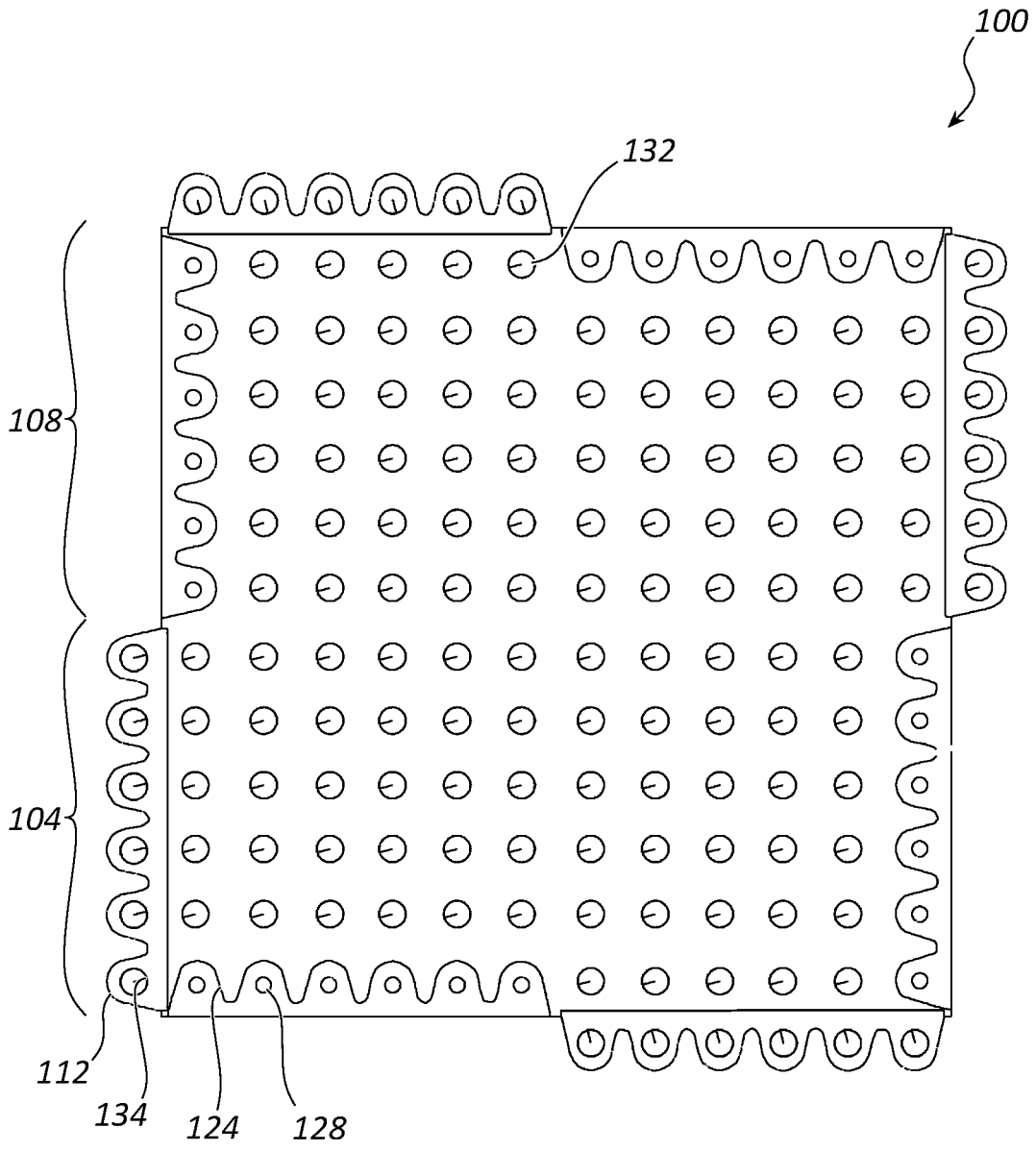
FIG. 2 is a bottom view of the tile of the embodiment shown in FIG. 1.

FIG. 2 is a bottom view showing the underside of the tile 100. The bottom surface of the tile 100 can include a plurality of pads 132. The pads 132 can be cushioned domes capable of bending and flexing in response to movement. The pads 132 can be enhanced even more by a natural resilience and deflection of a rubber compound used in the manufacturing of the tile 100. The domes 132 distribute weight evenly to allow a worker to stand upright and steady on the tile 100.

The bottom of each tab 112 can also comprise a pad 134. The pads 134 can be substantially similar to the pads 132 disposed on the bottom surface of the tile 100. In some embodiments, the interior of the pad 134 defines the cavity 116. As depicted in FIG. 2, the indented portion 108 can comprise one or more cut-away portions or indentations 124 in the bottom of the tile 100 and along the edge. The indentations 124 can be sized and shaped similar to the tabs 112 such that the tabs 112 can be received into the indentions 124 of a corresponding tile.

Each indentation 124 can correspond in shape to a tab 112 such that the indentation and tab fit together, such as a hand-in-glove type of fit. Each indentation 124 can also comprise a protrusion 128 that extends from the indentation 124. The protrusions 128 can be cylindrical and can extend perpendicularly from the plane of the tile 100. The protrusions 128 can be shaped and sized similar to the cavities 116 formed in the tabs 112 to allow the protrusions 128 to be inserted into the cavities 116. In some embodiments, the protrusions 128 can be configured to form a friction-fit or snap-fit connection with the cavities 116. The connections between the protrusions 128 and the cavities 116 can be intended to be detachable or permanent.

Thus, the present disclosure implements a multi-connection method for connecting modular tiles. The multi-connection method includes the overlapping/woven configuration of the tabs 112, the tabs 112 tightly fitting into the indentations 124, and the protrusions 128 being inserted into the cavities 116. This system is stronger than conventional attachment methods and reduces the occurrence of gaps and raised surfaces.

Once mated, the combined thickness of the tabs 112 and the indented portions 108 is approximately equal to the central thickness of the tile 100. In other words, the area proximate the seams of mated tiles is uniform with the rest of the tiles, such that no discernable change in the feel of the floor mat can be sensed by a user. This uniformity in thickness can be appreciated when considering the side view illustrated in FIG. 4. Further, the connection area does not impact the level of comfort of the floor mat thanks to the pads 134 on the bottom of the tabs 112.

Figure 3:
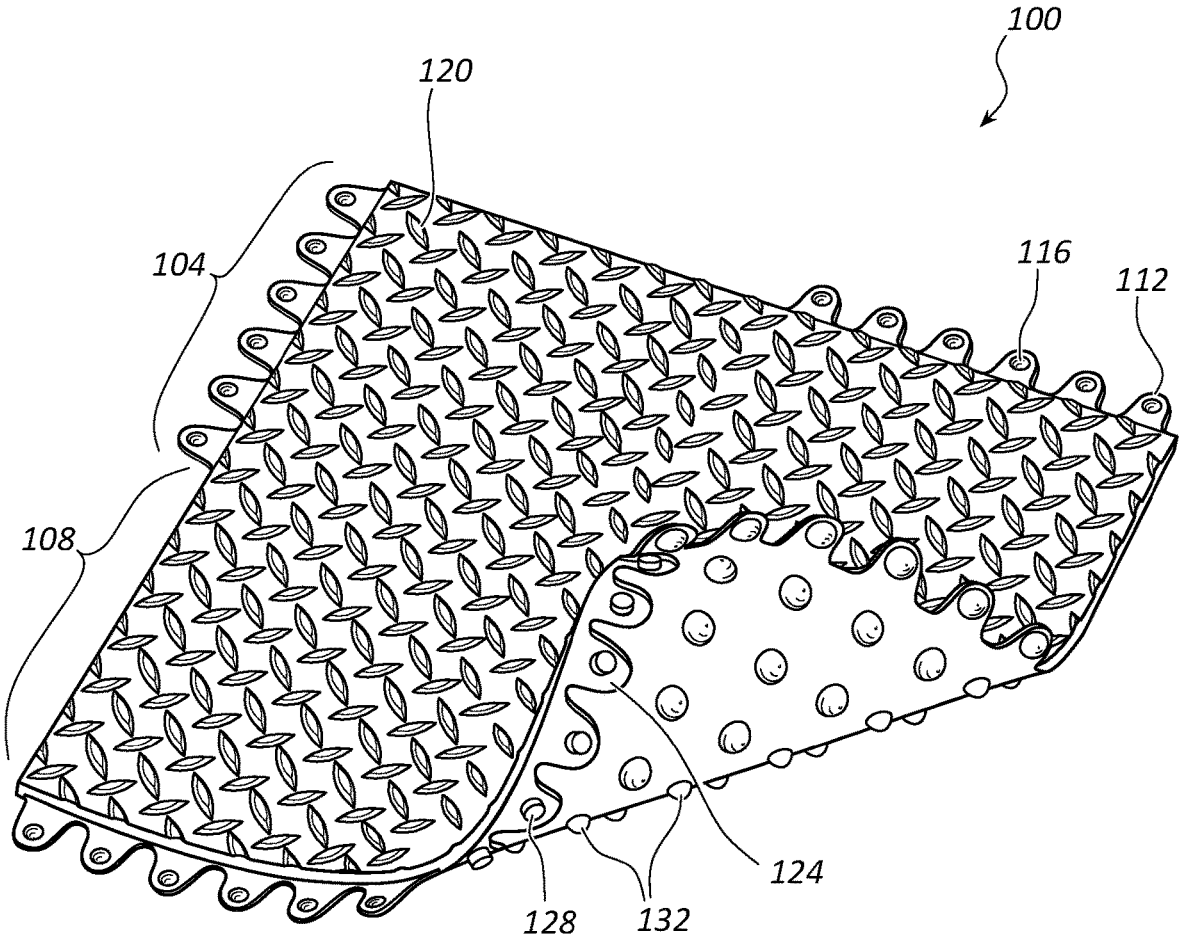
FIG. 3 is a top perspective view of the tile with a corner of the tile folded over.

FIG. 3 is a top perspective view of the tile 100 with a corner of the tile 100 folded over, exposing the bottom surface. The tile 100 can be flexible, which can aid in the assembly of the floor mat. For instance, flexibility in the tiles can make it easier to mate the tabbed portions 104 with the indented portions 108 of adjoining tiles. In some embodiments, the tabs 112 can be more flexible than the rest of the tile 100. For instance, the tile 100 can be substantially rigid, except for the tabs 112 which bend and flex in order to connect with corresponding indentations 124.

Figure 4:
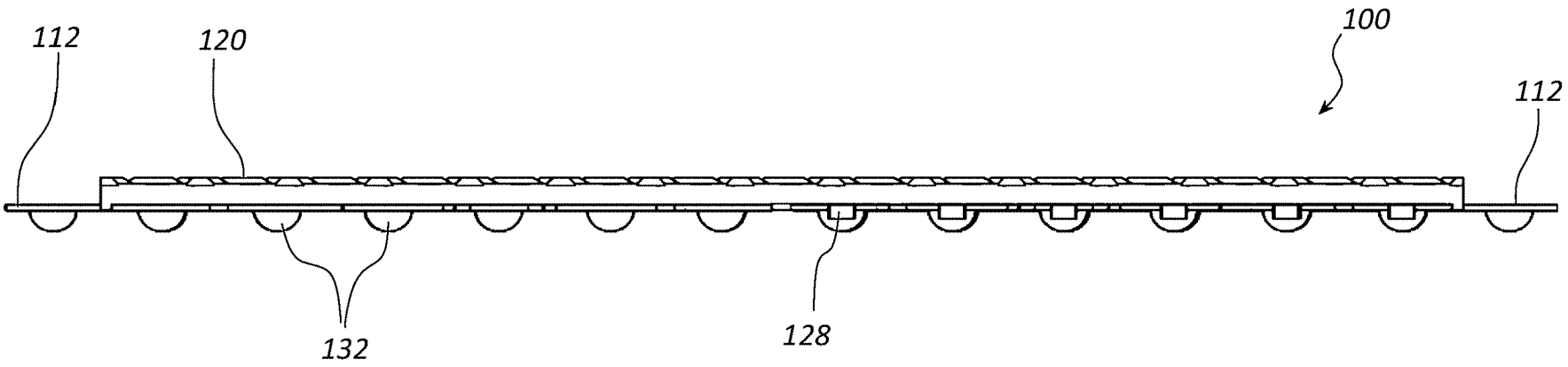
FIG. 4 is a side view of the tile.
Figure 5:
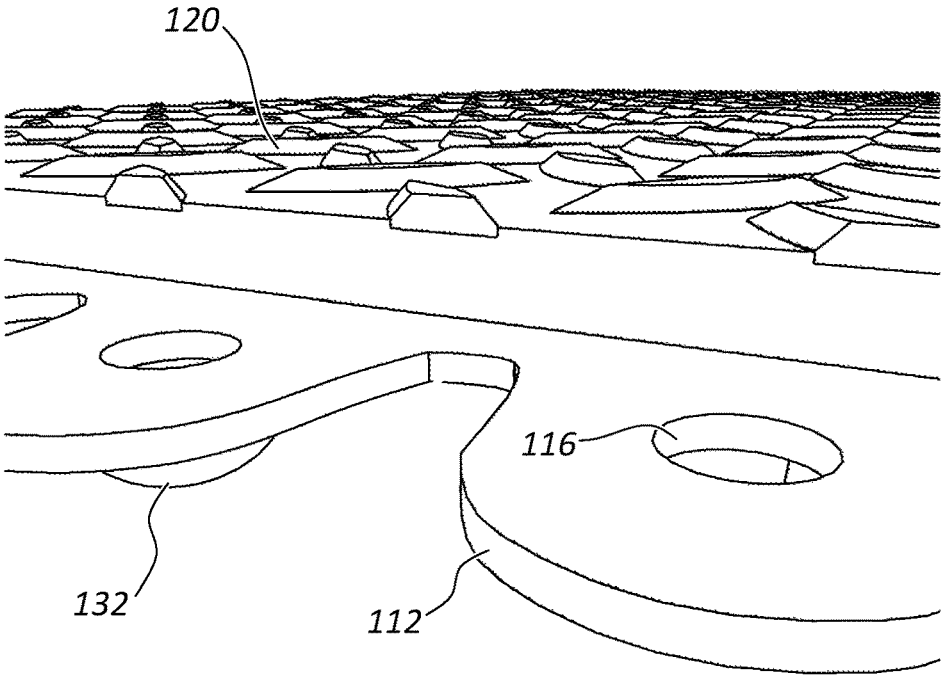
FIG. 5 is a close-up top perspective view of tabs that extend from a side of the tile.
Figure 6:
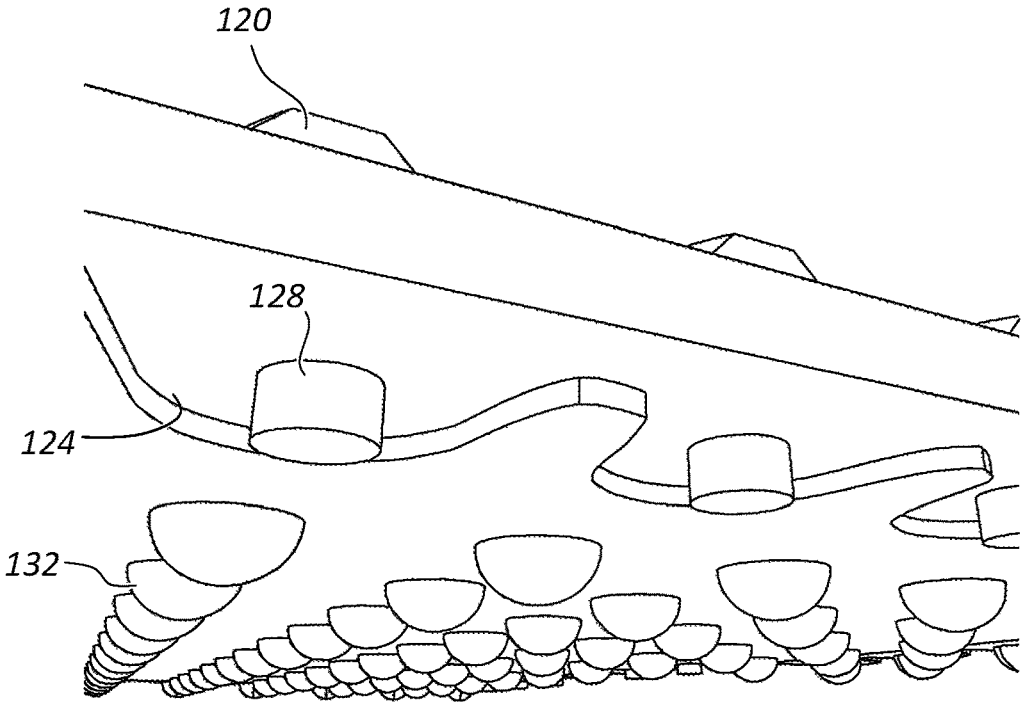
FIG. 6 is a close-up perspective bottom view of the underside of the tile.

FIG. 4 is a side view of the tile 100. In some embodiments, the tile 100, and consequently the floor mat, can be approximately 19 mm thick to elevate and insulate the worker from the hard ground. FIGS. 5 and 6 are close-up perspective views of the top of the tabs 112 and the underside of the tile 100 respectively.

Figure 7:
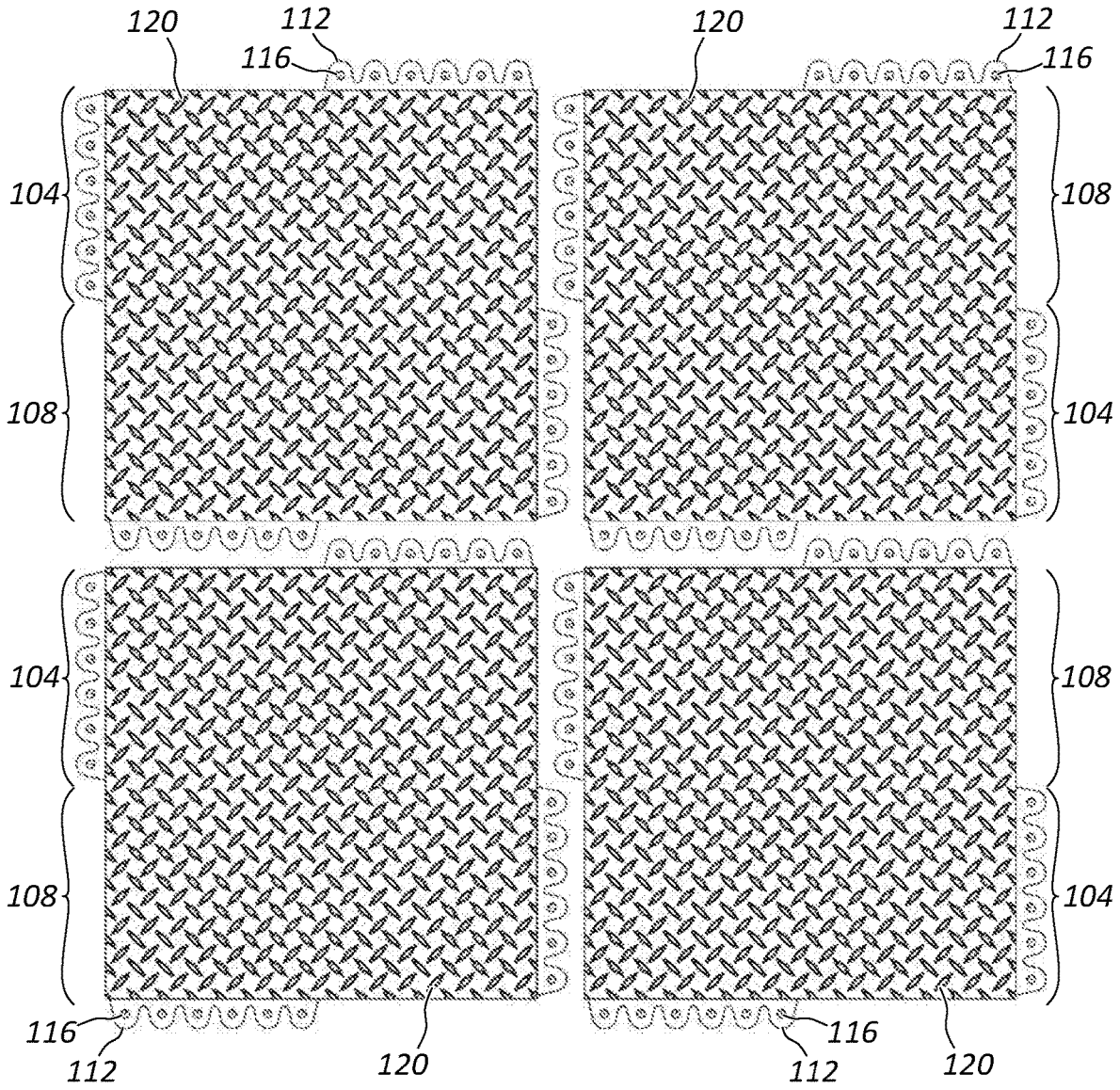
FIG. 7 is a top view of a plurality of tiles in accordance with the embodiment of FIG. 1.

FIG. 7 is a top view of a plurality of tiles in accordance with the embodiments discussed above. The plurality of tiles are assembled to produce a large floor mat. Each side of the tiles can comprise identical edges with tabbed portions 104 and indented portions 108. It will be appreciated, the fact that every edge identical means that any one edge of a tile can be attached to any edge of a corresponding tile. Thus, assembly of the floor mat is simplified because the installer is not concerned with the orientation of the tiles. Identical edges can also simplify the manufacturing process of the tiles.

Figure 8:
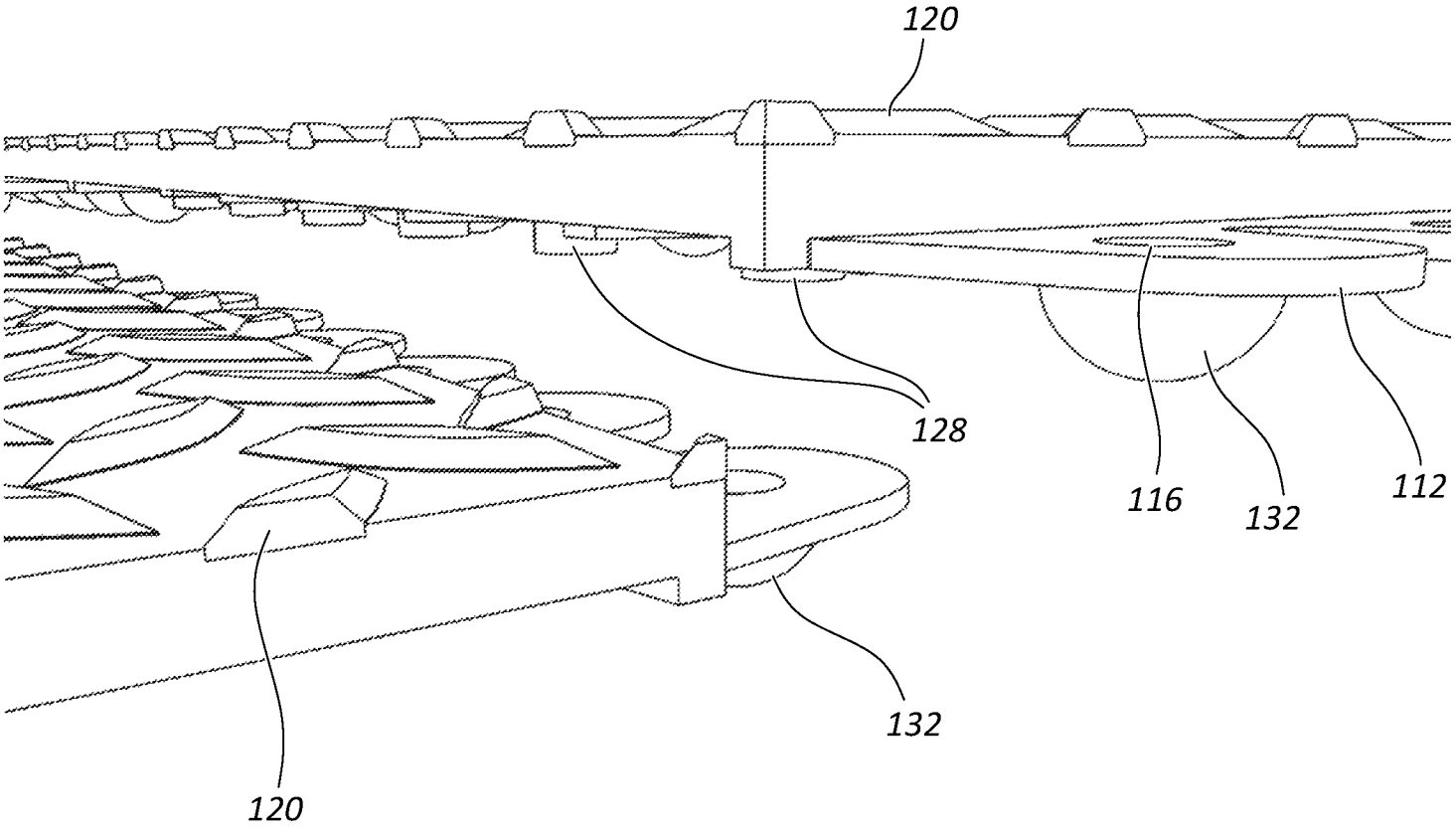
FIG. 8 is a perspective view of two tiles that are aligned to be coupled.
Figure 9:
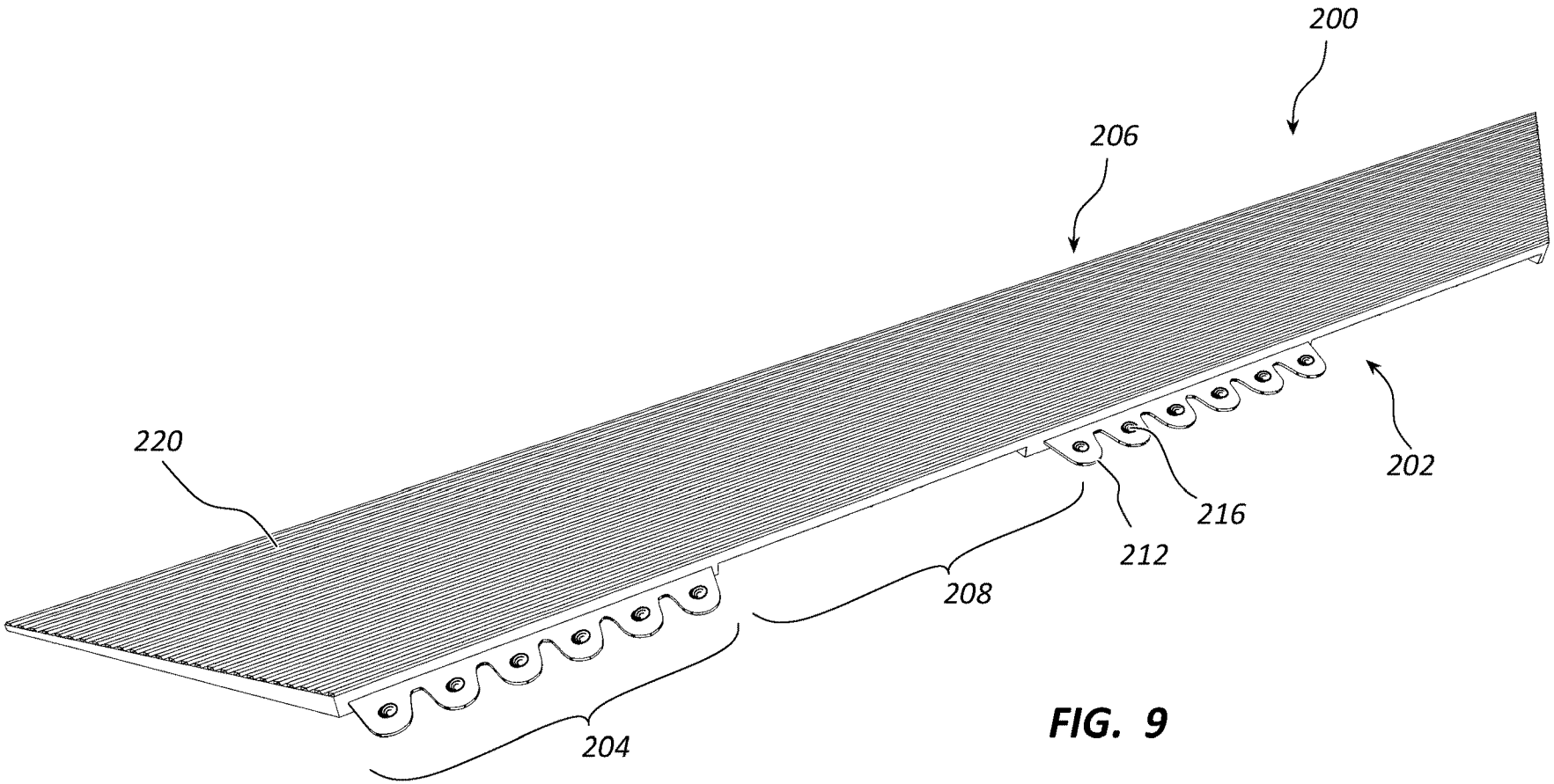
FIG. 9 is a ramp for use with the floor mat formed by the tiles in accordance with one embodiment.

FIG. 8 illustrates two tiles aligned to be coupled. As discussed above, each edge of the tiles can include a multi-interlocking connection system that includes tabs 112 and indentations 124 that are configured to mate with corresponding tabs and indentations on other tiles. It will be appreciated that unlike conventional modular mats, the tiles cannot be separated simply by applying a unidirectional force to one of the tiles. Thus, the woven-like design reduces the possibility of inadvertent separation of the tiles.

As depicted in FIGS. 9-12, the floor mat can also comprise a ramp 200. The ramp 200 can prevent tripping and allow cart access to the floor mat. The ramp 200 can comprise a roughly 6 inch gradual bevel for greater ease onto or off of the work platform. The ramp 200 can comprise an interlocking edge 202 configured to abut and interlock with an edge of the tile 100. The interlocking edge 202 can comprise a tabbed portions 204 and an indented portions 208. The interlocking edge 202 of the ramp 200 can comprise one or more tabs 212 that protrude from the interlocking edge 202. The tabs 212 can be substantially similar to the tabs 112 on tile 100. The ramp tabs 212 can each comprises a ramp cavity 216 and a ramp pad 232 opposite the ramp cavity 216.

Figure 10:
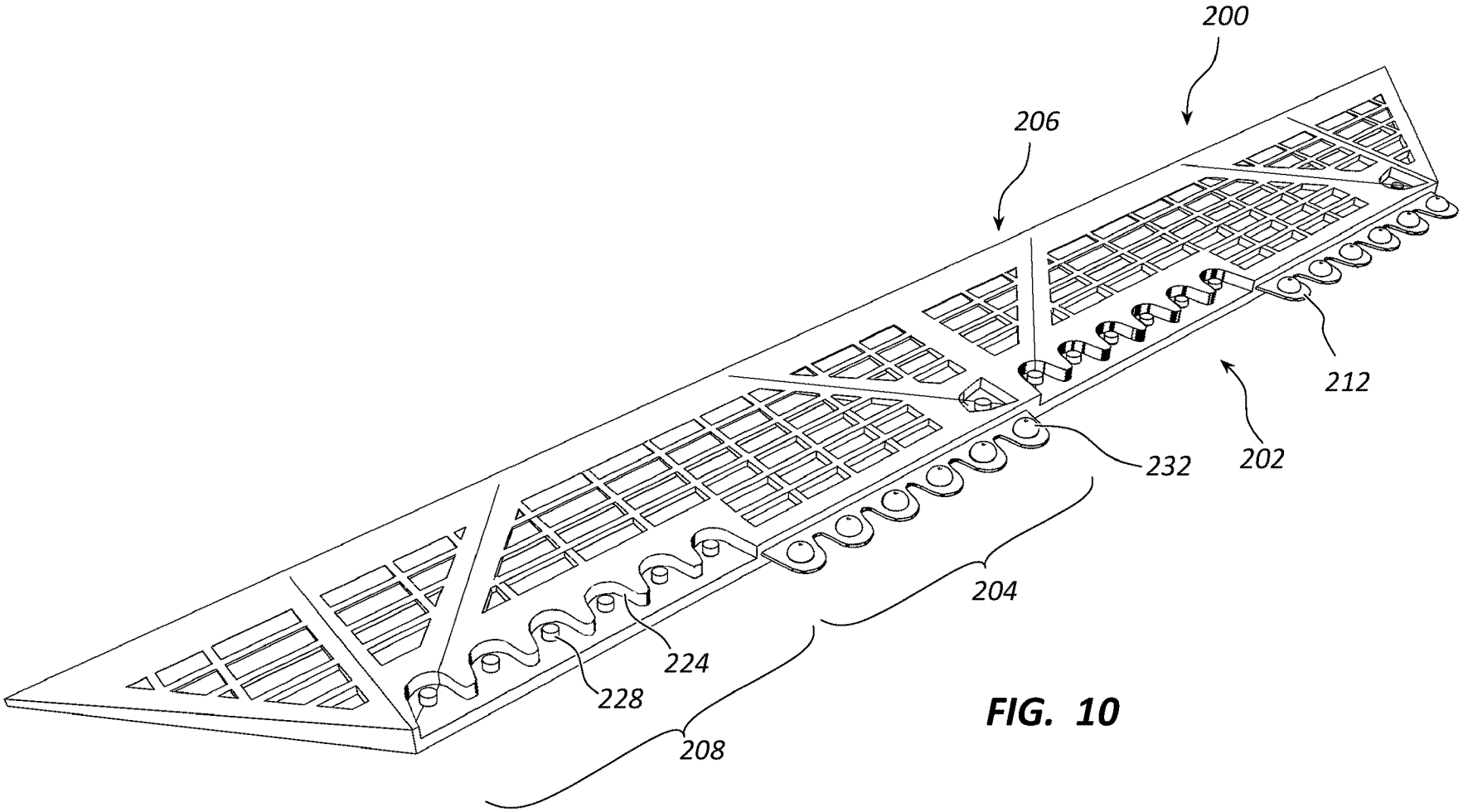
FIG. 10 is the underside of the ramp according to the embodiment of FIG. 9.

As depicted in FIG. 10, one or more ramp indentations 224 can be disposed on a bottom of the ramp 200 and laterally spaced from the ramp tabs 212 along the interlocking edge 202. Each ramp indentation 224 can comprise a ramp protrusion 228 that extends perpendicularly from the ramp indentation 224. The ramp indentations 224 and protrusions 228 can be substantially similar to the indentations 124 and protrusions 128 on tile 100. The ramp tabs 212 can be configured to mate with the indentations 124 disposed on the bottom of the tile 100, and the ramp cavities 216 can be configured to receive the protrusions 128 extending from the indentations 124 of the tile 100.

Figure 11:
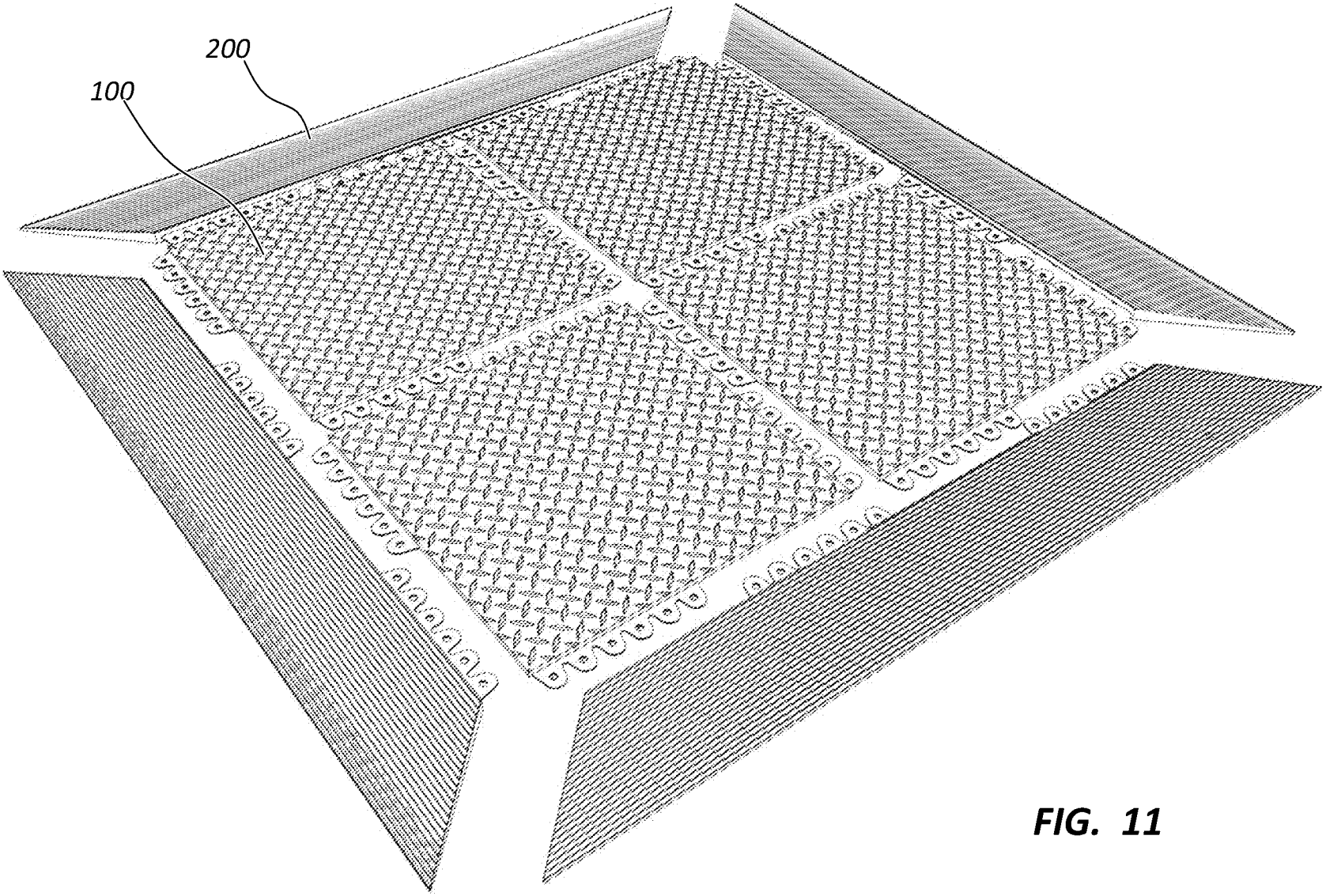
FIG. 11 is a top perspective view of a disassembled floor mat including tiles and ramps.

The ramp 200 can be configured to mate with any edge of the tile 100 to create a beveled edge of the floor mat. As illustrated in FIG. 11, in some embodiments, the ramp 200 is attached to more than one tile along the interlocking edge 202. The ramp 200 can be made from a nitrile base rubber compound. The ramp 200 can fit either side of the mat, eliminating the need for male/female ends. Further, the top surface of the ramp 200 can comprise a textured surface to improve traction.

Figure 12:
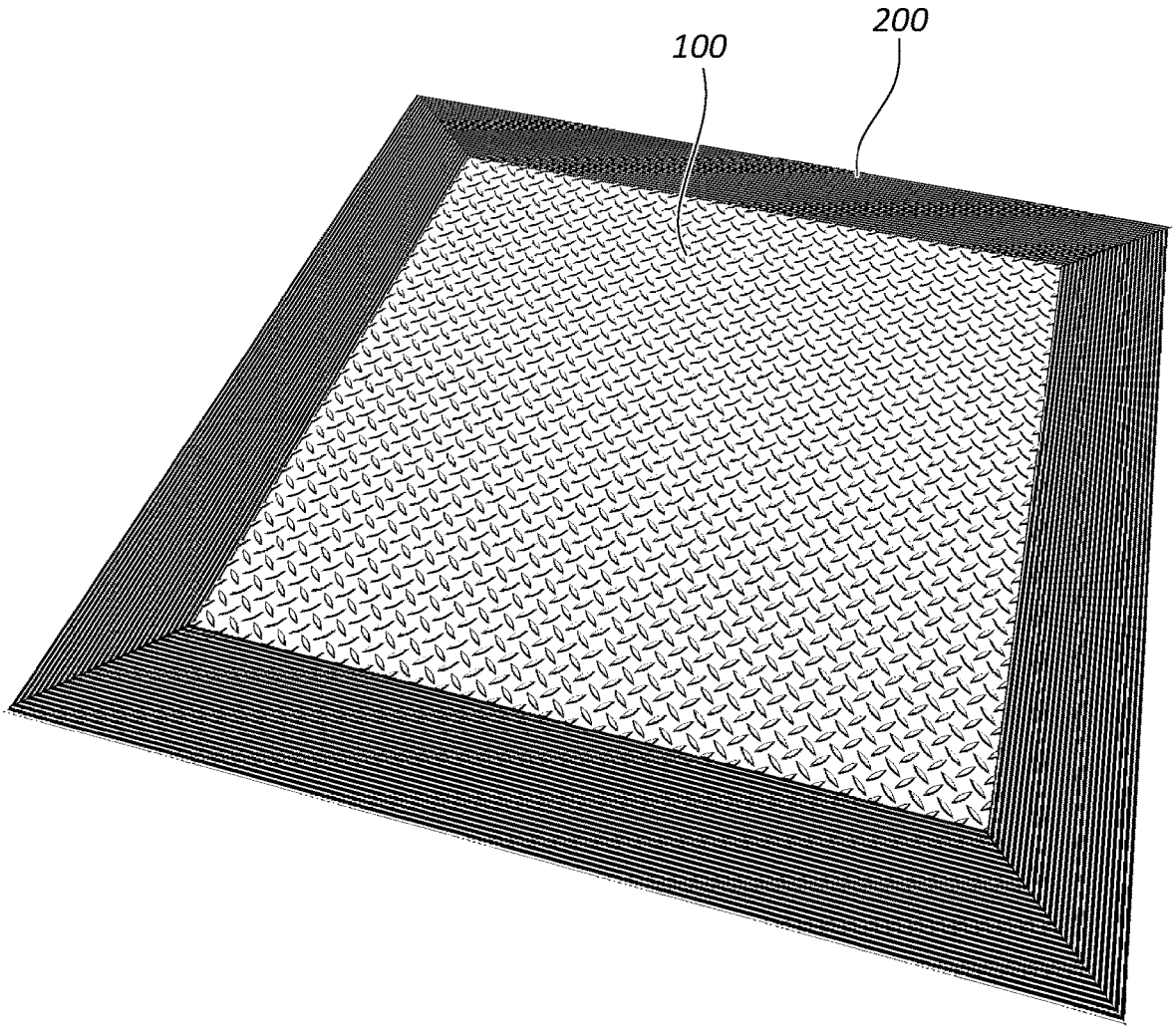
FIG. 12 is a top perspective view of an assembled floor mat including tiles and ramps.

In some embodiments, the ramp 200 can comprise a mitered corner configured to abut a corresponding mitered corner to form a right angle. The corners of the ramp can be coupled together using a variety of coupling methods. For instance, the ramp 200 can comprise a flange (not shown) that protrudes from the ramp 200 and couples with an adjoining ramp to form a beveled corner. Square edges can be achieved on the ramp 200 by trimming off the mitered corner using a cut line on the bottom of the ramp 200. As shown in FIG. 12, in some embodiments, the floor mat comprises only a single tile 100, yet utilizes the multi-connection methods described above to connect with ramps 200.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including" and "having" come as used in the specification and claims shall have the same meaning as the term "comprising."

What is claimed is:

1. A floor mat comprising:

a set of interlocking tiles, each tile comprising:

a tab protruding from a first edge of the tile, the tab comprising a pad and defining a cavity opposite the pad;

an indentation disposed on a bottom of the tile and laterally spaced from the tab along the first edge; and a protrusion extending from the indentation;

wherein the tab is configured to mate with a corresponding indentation on a corresponding tile; and wherein the protrusion is configured to be inserted into a corresponding cavity on a corresponding tab on the corresponding tile.

2. The floor mat of claim 1, wherein the tile comprises multiple edges, the multiple edges including the first edge and a plurality of additional edges, each additional edge being identical to the first edge.

3. The floor mat of claim 2, wherein any one of the multiple edges can mate with the corresponding tile.

4. The floor mat of claim 1, wherein the bottom of the tile comprises a plurality of pads configured to allow the tile to bend and flex.

5. The floor mat of claim 1, wherein the pad on the tab is a cushioned dome.

6. The floor mat of claim 1, wherein the cavity of the tab defines an interior of a pad of the tab.

7. The floor mat of claim 1, wherein a top of the tile comprises a gripping surface.

8. The floor mat of claim 1, wherein the tile comprises material that is capable of deforming under the weight of a person.

9. The floor mat of claim 1, wherein upon interlocking the tile and the corresponding tile are approximately flush.

10. The floor mat of claim 1, wherein interlocking the tile with the corresponding tile does not increase the thickness of the floor mat.

11. The floor mat of claim 1, wherein another edge of the tile is beveled to create a ramp onto the floor mat.

12. The floor mat of claim 1, further comprising a ramp comprising:

an interlocking edge configured to abut and interlock with a second edge of the tile;

a ramp tab protruding from the interlocking edge of the ramp, the ramp tab comprising a ramp cavity and a ramp pad opposite the ramp cavity;

a ramp indentation disposed on a bottom of the ramp and laterally spaced from the ramp tab along the interlocking edge; and a ramp protrusion extending from the ramp indentation;

wherein, the ramp tab is configured to mate with a second indentation disposed on the bottom of the tile, proximate the second edge of tile, and the ramp cavity is configured to receive a second protrusion extending from the second indentation.

13. The floor mat of claim 12, wherein the ramp is configured to selectively mate with at least one other edge of the tile.

14. The floor mat of claim 12, wherein the ramp comprises a mitered corner.

15. The floor mat of claim 12, wherein the ramp comprises a flange that protrudes from the ramp and couples with an adjoining ramp to form a beveled corner.

16. The floor mat of claim 12, wherein the ramp creates a beveled edge of the floor mat.

17. A method for interlocking two tiles to form a floor mat comprising:

providing a first tile comprising:

a tab protruding from an edge of the tile, the tab comprising a cavity and a pad opposite the cavity;

an indentation disposed on a bottom of the tile and laterally spaced from the tab along the edge; and a protrusion extending from the indentation;

providing a second tile comprising:

a second tab protruding from an abutting edge of the second tile, the second tab comprising a second cavity and a second pad opposite the second cavity;

a second indentation disposed on a bottom of the second tile and laterally spaced along the abutting edge from the second tab; and a second protrusion extending from the second indentation;

mating the tab with the second indentation; and inserting the protrusion into the second cavity.

18. The floor mat of claim 17, wherein the first tile comprises multiple edges including the first edge and a plurality of additional edges, wherein any one of the multiple edges can mate with the abutting edge of the second tile.

19. The floor mat of claim 17, wherein interlocking the tile with the second tile does not increase the thickness of the floor mat.

20. The floor mat of claim 17, wherein upon interlocking, the tile and the corresponding tile are approximately flush.

* * * * *